US006871472B2

(12) United States Patent
Folkersen

(10) Patent No.: US 6,871,472 B2
(45) Date of Patent: Mar. 29, 2005

(54) SEALED ROOF AND METHOD FOR SEALING A ROOF

(76) Inventor: Jonny Folkersen, Edward Dr., P.O. Box 327, East Wakefield, NH (US) 03830

( * ) Notice: Subject to any disclaimer, the term of this patent is extended or adjusted under 35 U.S.C. 154(b) by 178 days.

(21) Appl. No.: 10/460,540

(22) Filed: Jun. 11, 2003

(65) Prior Publication Data

US 2004/0016201 A1 Jan. 29, 2004

Related U.S. Application Data

(63) Continuation-in-part of application No. 10/140,365, filed on May 6, 2002, now abandoned, which is a continuation of application No. 09/803,692, filed on Mar. 9, 2001, now Pat. No. 6,401,424, which is a continuation of application No. 09/447,605, filed on Nov. 23, 1999, now Pat. No. 6,209,283, which is a continuation-in-part of application No. 09/032,202, filed on Feb. 27, 1998, now Pat. No. 6,023,906.

(51) Int. Cl.[7] ..... E04D 1/00

(52) U.S. Cl. ..... 52/746.11; 52/746.1; 52/748.1; 52/409; 52/518; 52/DIG. 16

(58) Field of Search ..... 52/746.11, 746.1, 52/748.1, 409, 518, 747.1, 748.11, 741.7, DIG. 16

(56) References Cited

U.S. PATENT DOCUMENTS

| | | | | | |
|---|---|---|---|---|---|
| 1,418,377 | A | * | 6/1922 | Jaynes | 52/420 |
| 2,044,782 | A | * | 6/1936 | Harshberger | 52/232 |
| 2,144,168 | A | * | 1/1939 | Sherriff | 52/420 |
| 2,226,239 | A | * | 12/1940 | Elmendorf | 52/409 |
| 2,246,514 | A | * | 6/1941 | Harris | 52/746.11 |
| 2,394,380 | A | * | 2/1946 | Herbes | 52/748.11 |
| 4,825,616 | A | * | 5/1989 | Bondoc et al. | 52/518 |
| 4,932,171 | A | * | 6/1990 | Beattie | 52/58 |
| 5,512,118 | A | * | 4/1996 | Davis et al. | 156/157 |

* cited by examiner

*Primary Examiner*—Brian E Glessner
(74) *Attorney, Agent, or Firm*—Robert W. Nelson; Klass, Law, O'Meara & Malkin, P.C.

(57) ABSTRACT

A method for sealing a roof is disclosed herein. The roof is of the type comprising an inclined substrate and a first layer of shingles. The first layer of shingles has a first side and a second side wherein the first layer of shingles first side is attached to the substrate. The method comprises a first party selecting a second party to seal the roof. The first party provides a waterproof membrane having a first side and a second side to the second party. The second party positions the membrane first side adjacent at least a portion of the first layer of shingles second side. The second party attaches a second layer of shingles to the substrate, wherein the second layer of shingles is adjacent the membrane second side.

22 Claims, 7 Drawing Sheets

SEALED ROOF AND METHOD FOR SEALING A ROOF

This application is a Continuation-in-Part application of application Ser. No. 10/140,365, filed on May 6, 2002, now abandoned which was a Continuation of a U.S. patent application Ser. No. 09/803,692 (now U.S. Pat. No. 6,401,424), filed on Mar. 9, 2001, which was a continuation application of continuation-in-Part application Ser. No. 09/447,605 (now U.S. Pat. No. 6,209,283) filed on Nov. 23, 1999, which was a Continuation-in-Part application of application Ser. No. 09/032,202, filed Feb. 27, 1998, now U.S. Pat. No. 6,023,906; are all hereby incorporated by reference for all that is disclosed therein.

BACKGROUND

Many shingled roofs acquire leaks, which may damage their underlying structures. One cause of leaky roofs is improper installation of the roofs. For example, some roofing installers do not use adequate tar paper during installation of a shingled roof. This may result, as an example, in a roof that should last for thirty years only lasting five or ten years. Another installation problem may occur with flashing not being properly affixed or sealed.

Some shingled roofs can be repaired. For example, a second layer of shingles may be applied to a first layer of shingles. As with an original shingled roof, improper installation of the second layer of shingles may cause the roof to leak prematurely. In addition to the aforementioned problems, a repaired shingled roof may leak if the underlying substrate is defective. For example, if the substrate is plywood and has rotted, the repaired roof may leak prematurely.

When a shingled roof is improperly installed or repaired, any applicable warranties on the roofing shingles or other products may be voided by the manufacturers. For example, a roofing shingle manufacturer may warranty a roofing shingle for thirty years provided that it is installed properly. An installer may not properly install the roofing shingles and the roof may leak after ten years. Because of the improper installation, the roofing shingle manufacturer is not liable to replace the roof. The owner of the structure may turn to the installer for compensation. However, the installer may be out of business or not have the funds to cover the owner's losses. Accordingly, the owner is left without a remedy.

SUMMARY

A method for sealing a roof is disclosed herein. The roof is of the type comprising an inclined substrate and a first layer of shingles. The first layer of shingles has a first side and a second side wherein the first layer of shingles first side is attached to the substrate. The method comprises a first party selecting a second party to seal the roof. The first party provides a waterproof membrane having a first side and a second side to the second party. The second party positions the membrane first side adjacent at least a portion of the first layer of shingles second side. The second party attaches a second layer of shingles to the substrate, wherein the second layer of shingles is adjacent the membrane second side.

DETAILED DESCRIPTION

The following description is divided into two portions. The first portion relates to a roof and a method for sealing a roof. The second portion relates to a business method governing the application of the roof onto a structure.

The Roof and Method

Figure 1:
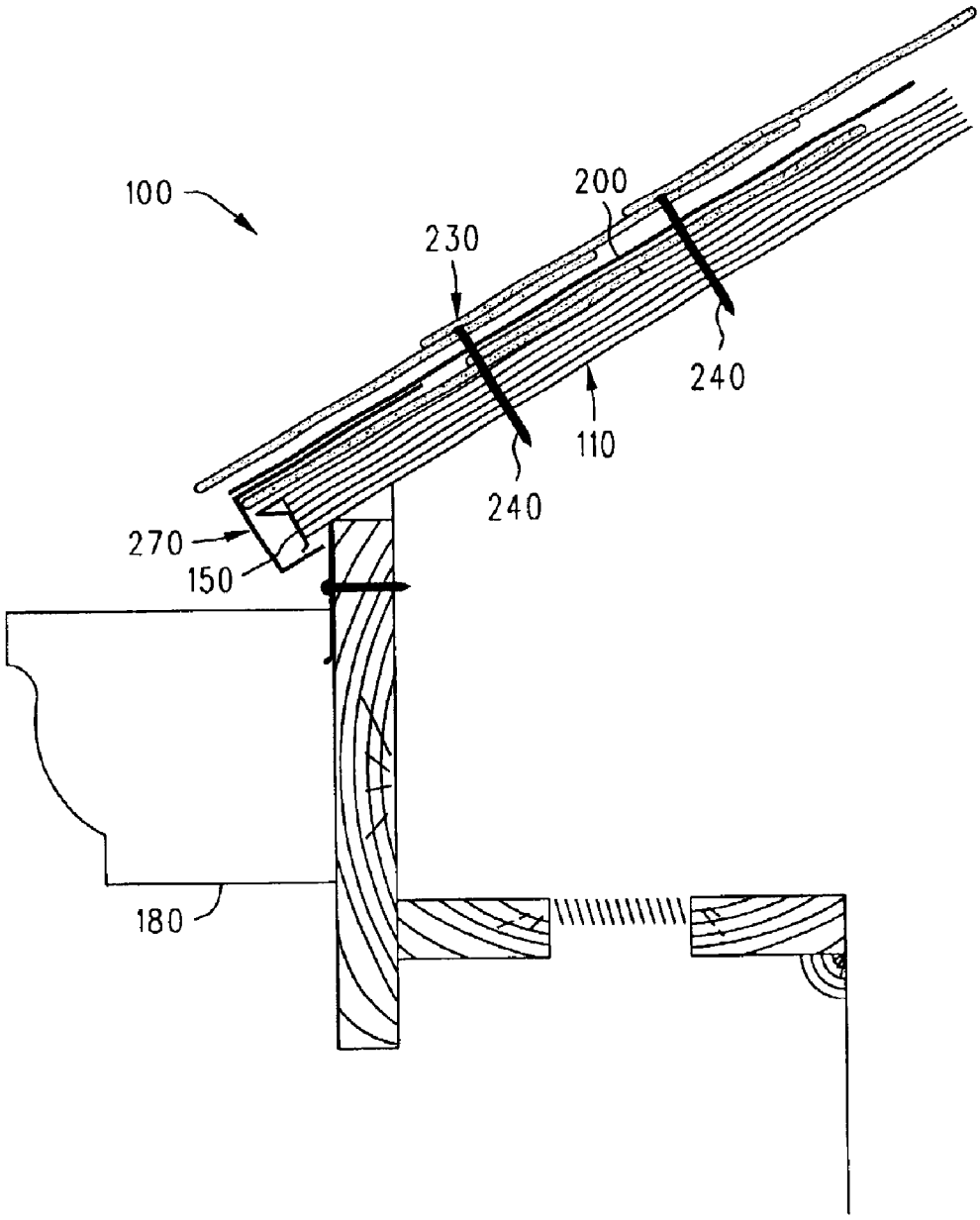
FIG. 1 is a side cut away view of a sealed roof.

Referring to FIG. 1, a sealed roof 100 and a method of sealing a roof are disclosed herein. The method disclosed herein describes the process of sealing a conventional roof 108, FIG. 2, to achieve the sealed roof 100 of FIG. 1. Accordingly, the following description describes the conventional roof 108 of FIG. 2 and is followed by a description of the method to achieve the sealed roof 100 of FIG. 1.

Figure 2:
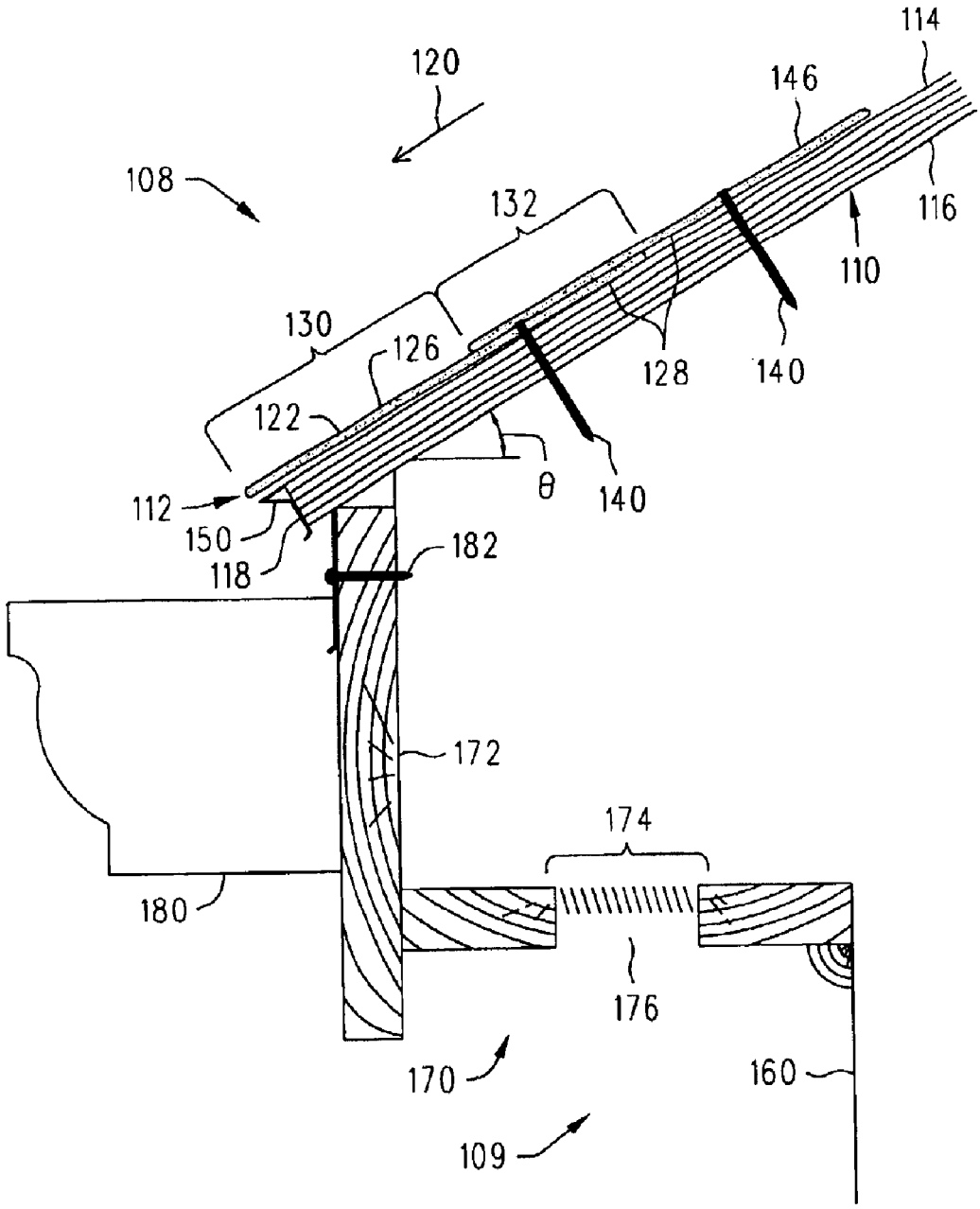
FIG. 2 is a side cut away view of a conventional roof.

Referring to FIG. 2, which is a cut away view of the conventional roof 108, the conventional roof 108 is described herein in a non-limiting manner as being part of a structure 109, such as a house. The conventional roof 108 sets upon the structure 109 and serves to keep precipitation, such as rain and snow, from entering the structure 109. The conventional roof 108 typically has a substrate 110 with a layer of shingles 112 attached thereto. The substrate 110 may, as a non-limiting example, be a plurality of plywood sheets. The substrate 110 has a top side 114, a bottom side 116, and an end 118. The top side 114 is a surface that faces away from the structure 109 and the bottom side 116 is a surface that faces toward the structure 109. The substrate 110 is inclined at an angle θ relative to the earth, which is known in the art as the pitch of the roof. This incline forces water to flow in a direction 120 off the roof.

The shingles 112 are described herein in a non-limiting manner as being conventional roofing shingles. The shingles 112 may, as examples, be asphalt or fiberglass based roofing shingle as are known in the art. With reference to a first shingle 122, all the shingles 112 may have a top side 126, a bottom side 128, an exposed portion 130 and an overlapped portion 132. During construction of the conventional roof 108, the first shingle 122 may be placed on the top side 114 of the substrate 110 so that the bottom side 128 of the first shingle 122 is adjacent the top side 114 of the substrate 110. The exposed portion 130 of the first shingle 122 typically extends slightly beyond the end 118 of the substrate 110 so as to keep water from contacting the substrate 110. A fastener 140, such as a nail, may be placed through the overlapped portion 132 of the first shingle 122 and into the substrate 110, thus, securing the first shingle 122 to the substrate 110. It should be noted that several fasteners 140 are typically used to secure the first shingle 122 to the substrate 110 and that the fastener 140 typically extends through the substrate 110.

After the first shingle 122 is secured to the substrate 110, a second shingle 146 is secured to the substrate 110. The exposed portion 130 of the second shingle 146 is placed over the overlapped portion 132 of the first shingle 122. Again, a fastener 140, such as a nail, is used to secure the second shingle 146 to the substrate 110. This overlapping of shingles 112 continues along the substrate 110, opposite the direction 120, until the substrate 110 is covered with shingles 112. Accordingly, the substrate 110 is covered with shingles 112 wherein the exposed portions 130 of the shingles 112 are exposed to the environment. It is to be understood that a plurality of fasteners 140 are typically used to secure each shingle 112 to the substrate 110.

Figure 3:
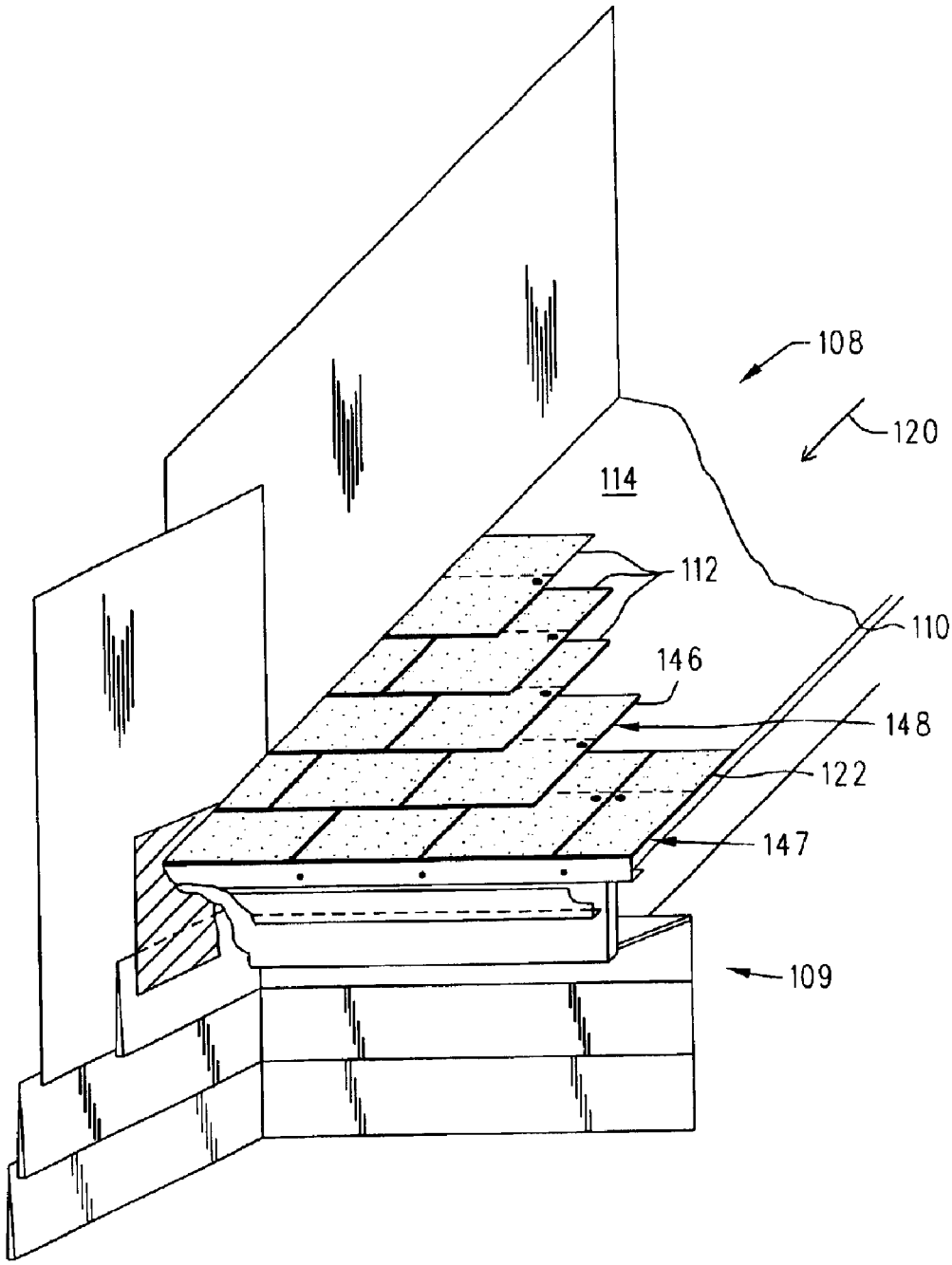
FIG. 3 is a top perspective view of the roof of FIG. 2.

Referring to FIG. 3, which is a top perspective view of the conventional roof 108, the shingles 112 are typically attached to the substrate 110 in rows. The first shingle 122 is attached to the substrate 110 along with other shingles 112 to form a first row 147. Subsequent to the attachment of the first row 147 to the substrate 110, the second shingle 146 and other shingles 112 are attached to the substrate 110 to form a second row 148. Attaching the shingles 112 to the substrate 110 in rows provides for the second row 148 to overlap the first row 147 over the length of the substrate 110. Accordingly, an upper row of shingles 112 overlaps its adjacent lower row of shingles 112. Water may then pass from an upper row of shingles 112 to its adjacent lower row in the direction 120 without contacting the substrate 110.

The rows 147, 148 have been described herein as being made of individual shingles 112. It is to be understood, however, that this is for illustration purposes only and that the rows 147, 148 may be made in various other forms. For example, the shingles 112 forming the rows 147, 148 may be extended sheets that are rolled onto the substrate 110 to form the rows 147, 148.

Referring again to FIG. 2, a conventional drip edge 150 may be affixed to the substrate 110 in the proximity of the end 118. The drip edge 150 is typically positioned between the first shingle 122 and the substrate 110 and serves to divert water away from the end 118 of the substrate 110 in a conventional manner.

Having described the substrate 110 and the conventional roof 108, the remaining elements of the structure 109 will now be described in a non-limiting manner.

The structure 109 described herein has a conventional exterior wall 160 located below the conventional roof 108. The exterior wall 160 defines the boundaries of the structure 109 and serves to support the conventional roof 108 in a conventional manner. The structure 109 also has an eave 170 located below the substrate 110 and adjacent the exterior wall 160. The eave 170 extends horizontally from the exterior wall 160 and may serve to keep water from dripping onto the exterior wall 160. The eave 170 is shown as having a first member 172 and a second member 174. The first member 172 extends vertically from the substrate 110 and the second member 174 extends horizontally from the exterior wall 160 and joins the first member 172. A conventional air vent 176 may be located in the second member 174. A conventional gutter 180 may be attached to the first member 172 by the use of a fastener 182. The gutter 180 serves to direct water falling from the conventional roof 108 away from the structure 109 in a conventional manner.

Having described the conventional roof 108, the process of sealing the conventional roof 108 to achieve the sealed roof 100 of FIG. 1 will now be described.

Figure 4:
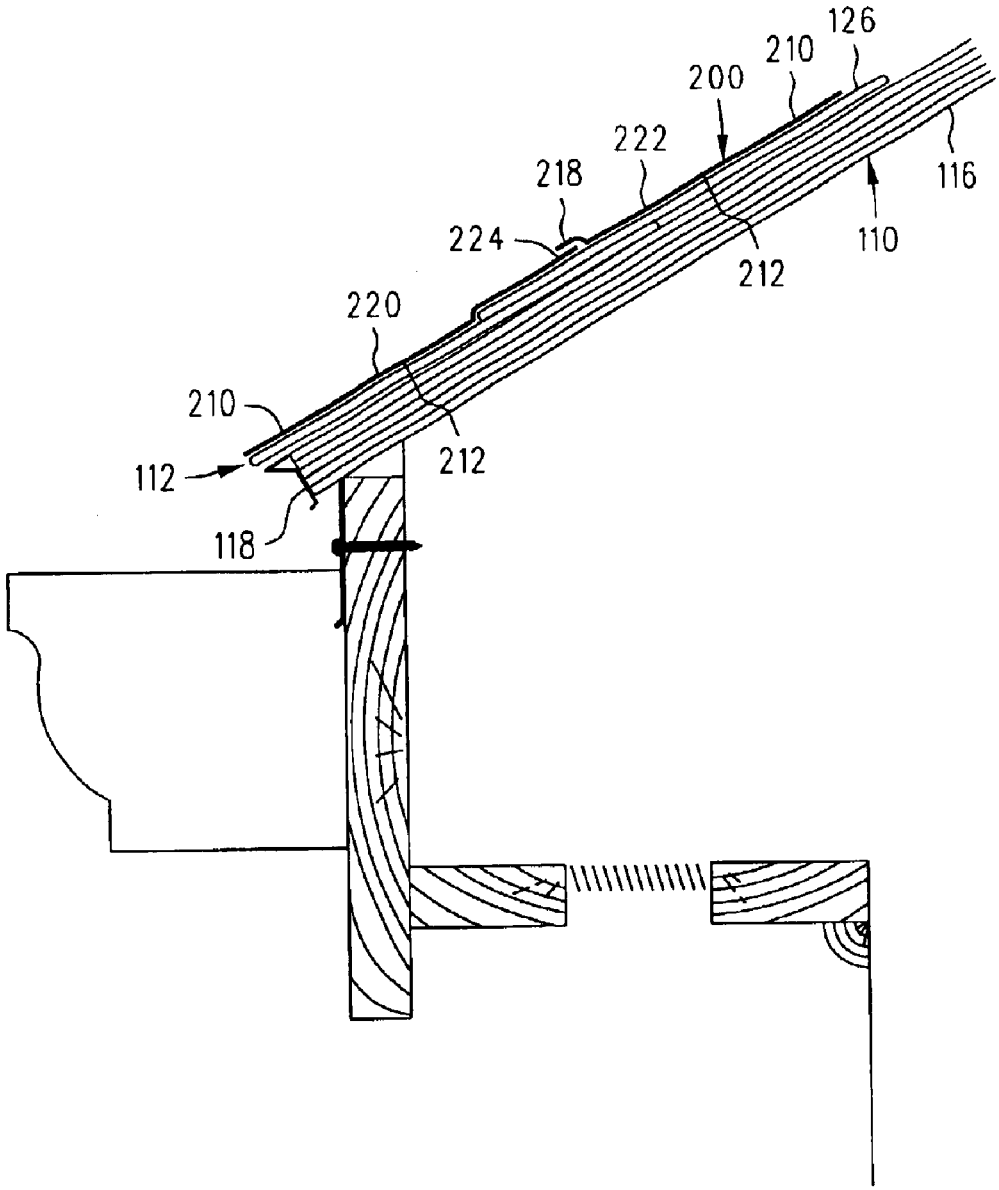
FIG. 4 is a side cut away view of the roof of FIG. 2 with a membrane located thereon.

Referring to FIG. 4, a waterproof membrane 200 may be placed adjacent the top side 126 of the shingles 112. The membrane 200 may be waterproof, durable, and able to conform to the shape of the top side 126 of the shingles 112. This allows the membrane 200 to form a waterproof layer over the shingles 112 that will not tear or otherwise become damaged upon application of a force to the membrane. For example the membrane 200 will not tear if a worker walks on the membrane 200 after it has been placed adjacent the top side 126 of the shingles 112. At least one surface of the membrane 200 may be adhesive or may be adapted to have an adhesive applied thereto. This allows the membrane 200 to adhere to the shingles 112. In addition, the membrane 200 may be inorganic, which prevents it from deteriorating when exposed to water and other deteriorating elements.

The membrane 200 may, as an example of a non-limiting embodiment, be comprised of reinforced styrene-butadiene-styrene (SBS) modified rubberized asphalt. The membrane 200 may be about 50 mils thick and may have a tensile strength of about 50 pounds per inch and a puncture resistance of about 80 pounds per the American Society for Testing and Materials (ASTM) D-412. It should be noted that the tensile strength, puncture resistance, and thickness are examples for illustration purposes and that these values may be lesser or greater depending on the roof to which the membrane 200 is applied. A non-limiting example of the membrane 200 uses polyester for the reinforcing material. Examples of the membrane 200 are of the type commercially available from the Protecto Wrap Company of Denver, Colo. and sold under the tradenames JIFFYSEAL, ICE & WATER GUARD, and RAINPROOF. It should be noted that the use of SBS is for illustration purposes and that other elastomers, polymers, or other similar materials may be substituted for the SBS described herein. Likewise, the use of polyester, as a reinforcing material is for illustration purposes and it is to be understood that other materials may be used to reinforce the membrane 200.

In another non-limiting example of the membrane 200, the membrane 200 may be a rubberized asphalt membrane having a fiberglass core. The membrane 200 may have a thickness of about 90 to 130 mils and a tensile strength of about 50 pounds per inch. This second example of a membrane may, as an example, be of the type commercially available from the NEI corporation of Brentwood, N.H. and sold under the tradename TOP SEAL.

The membrane 200 has a top side 210 and a bottom side 212, both of which are surfaces. The aforementioned thickness of the membrane 200 extends between the top side 210 and the bottom side 212. The bottom side 212 of the membrane 200 may be placed over the shingles 112 that are susceptible to water leakage caused by standing water. For example, the shingles 112 located in the vicinity of the eave 170 that are susceptible to water leakage caused by ice dams may be covered by the membrane 200. The membrane 200 may, as an example, then extend about 68 inches up the roof opposite the direction 120. Alternatively, the membrane 200 may be placed over all the shingles 112, which serves to seal the entire roof.

In a non-limiting embodiment of the membrane 200, the bottom side 212 is adhesive. For example, the bottom side 212 may be self-adhesive, meaning that it adheres to an object upon contacting the object without the addition of other chemicals or actions. The adhesive may, as a non-limiting example, be an SBS rubberized asphalt adhesive. During the application of the membrane 200, the bottom side 212 of the membrane 200 may be placed against the top sides 126 of the shingles 112. This placement of the membrane 200 causes the bottom side 212 of the membrane 200 to adhere to the top sides 126 of the shingles 112. Thus, the membrane 200 may be fully adhered to the top sides 126 of the shingles 112. Alternatively, an adhesive may be applied to either the bottom side 212 of the membrane 200 or the top side 126 of the shingles 112 so as to cause the membrane 200 to adhere to the shingles 112.

It is preferred that the membrane 200 substantially conform to the top sides 126 of the shingles 112. When the membrane 200 substantially conforms to the top sides 126 of the shingles 112, there are few, if any, spaces between the membrane 200 and the shingles 112. The lack of spaces ensures that the membrane 200 will not be subject to excessive tension upon application of a force being applied to the membrane 200. Accordingly, the membrane 200 is less likely to tear or otherwise become damaged upon the application of a force to the membrane 200. For example, when the membrane 200 conforms to the shingles 112, it is less likely to tear if an installer of the membrane 200 walks on the membrane 200. In addition, it is preferred that the membrane 200 not have any wrinkles. Wrinkles may cause the membrane 200 to wear prematurely.

In some applications, a single piece of the membrane 200 is not appropriately sized to cover all the shingles 112 that are susceptible to leakage. For example, referring to FIG. 5, which is a top view of a non-limiting example of the membrane 200, the membrane 200 may be manufactured in strips and packaged in rolls. The strips have a width WI, which may, as an example, be about 30 inches. The top side 210 of the membrane 200 may have a non-adhesive portion 216 and an adhesive portion 218. The adhesive portion 218 has a width W2 which may, as an example, be about 2.5 inches. The adhesive portion 218 may have a non-adhesive strip, not shown, covering and protecting it.

Figure 5:
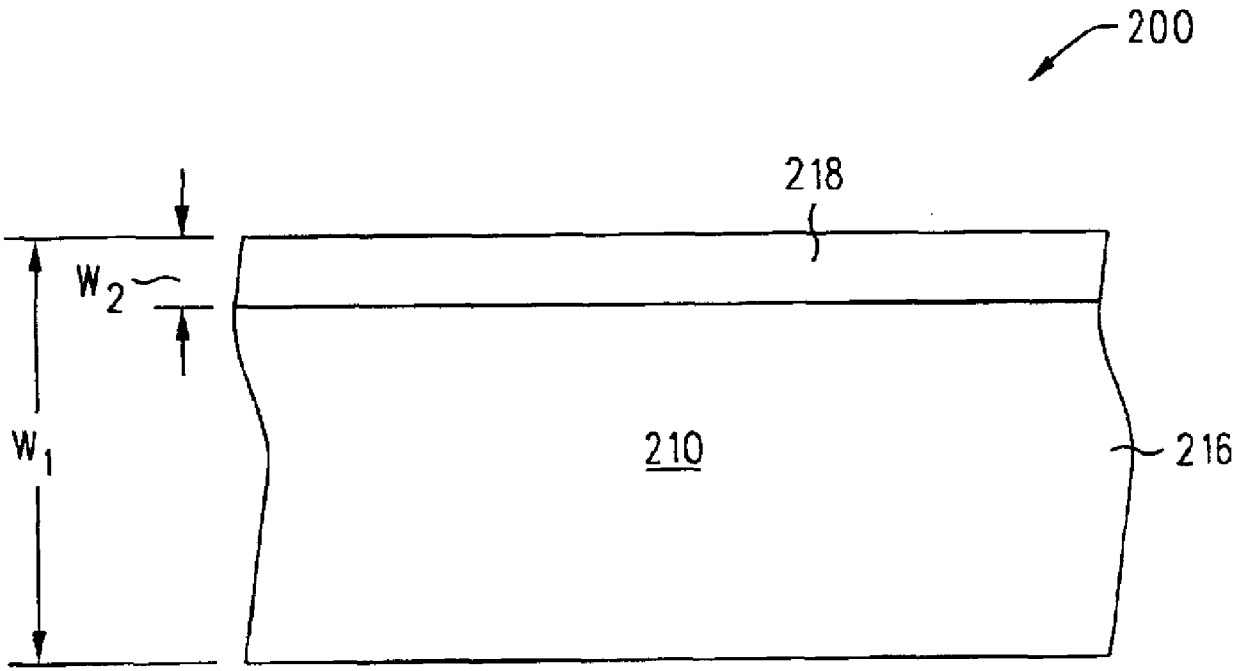
FIG. 5 is an illustration of the membrane of FIG. 4.

Referring to FIGS. 4 and 5, during the application of the membrane 200, a first strip 220 of the membrane 200 may be applied to the shingles 112 in the vicinity of the end 118 of the substrate 110. As described above, the bottom side 212 of the membrane 200 may be adhesive, thus, the bottom side 212 may adhere to the top side 126 shingles 112. When the first strip 220 is applied to the shingles 112, the aforementioned non-adhesive strip, not shown, covering the adhesive portion 218 of the top side 210 is removed exposing the adhesive portion 218. A second strip 222 of membrane 200 may then be placed onto the shingles 112 so that a portion of the bottom side 212 of the second strip 222 contacts the adhesive portion 218 of the first strip 220. Accordingly, an adhesive to an adhesive bond is created between the first strip 220 the second strip 222. This adhesive to adhesive bond, in turn, creates a continuous membrane 200 that is fully adhered to the shingles 112, and serves to form a waterproof layer on the shingles 112.

In order to further assure that the membrane 200 is waterproof, an adhesive may be applied at a junction 224 between the first strip 220 and the second strip 222. The adhesive may, as an example, be a conventional waterproof adhesive applied to form a ⅜ inch bead. In order to yet further assure that the membrane 200 is waterproof, the second strip 222 may overlap the first strip 220 by a distance greater than the width W2 of the adhesive portion 218. An additional bead of waterproof adhesive may be placed between the second strip 222 and the first strip 220.

In some roofing applications, a single strip of membrane 200 may not be long enough to extend the length of the roof. In such an application two strips may be abutted or overlapped. A waterproof adhesive may be placed at the junction of the strips to assure that the strips form a continuous waterproof membrane. For example a length, e.g., six inches, of one strip may overlap an adjacent strip. An adhesive may be applied between the strips at the overlap to improve the waterproof characteristic of the membrane 200.

Referring again to FIG. 1, when the membrane 200 is applied to the shingles 112, a second layer of shingles 230 may be placed on the membrane in an overlapping manner as was described above with reference to the shingles 112. The second layer of shingles 230 may be comprised of conventional roofing shingles as were described with regard to the shingles 112 on the conventional roof 108, FIG. 2. Fasteners 240 may be used to secure the second layer of shingles 230 to the substrate 110. The fasteners 240, such as nails, may pass through the second layer of shingles 230, the membrane 200, the shingles 112, and the substrate 110. Accordingly, the fasteners 240 may affix the second layer of shingles 230 to the substrate 110 and the membrane 200.

The chemical properties of the membrane 200 cause the membrane 200 to form a waterproof seal around the fasteners 240. For example, if the membrane 200 comprises an SBS modified rubberized asphalt, it may form a seal around the fasteners 240 to form a waterproof seal between the membrane 200 and the fasteners 240. Accordingly, the addition of the fasteners 240 does not deter from the waterproof property of the membrane 200 when the fasteners 240 pass through the membrane 200. Additionally, the composition, i.e., polyester reinforcement, of the membrane 200 allows it to contort without tearing or puncturing. Thus, workers installing the second layer of shingles 230 are able to sit and walk on the second layer of shingles 230 without rupturing or otherwise damaging the membrane 200. Likewise, heavy accumulations of ice and snow may build on the sealed roof 100 without rupturing or otherwise damaging the membrane 200.

In addition to the second layer of shingles 230 and the membrane 200, a new drip edge 270 may be applied to the sealed roof 100. The new drip edge 270 may substantially encompasses the drip edge 150. Accordingly, the new drip edge 270 may be installed over the drip edge 150 and removal of the drip edge 150 is not required. Thus, the use of the new drip edge 270 simplifies the above-described sealing process. The new drip edge 270 may be applied between the membrane 200 and the shingles 112 so as to assure that it does not deter from the waterproof characteristics of the sealed roof 100. For example, the drip edge 270 may be attached to the roof prior to the application of the membrane 200.

Having described the application of the membrane 200 on a roof, a description of flashing and sealing vertical walls adjacent the sealed roof 100 will now be described.

Figure 6:
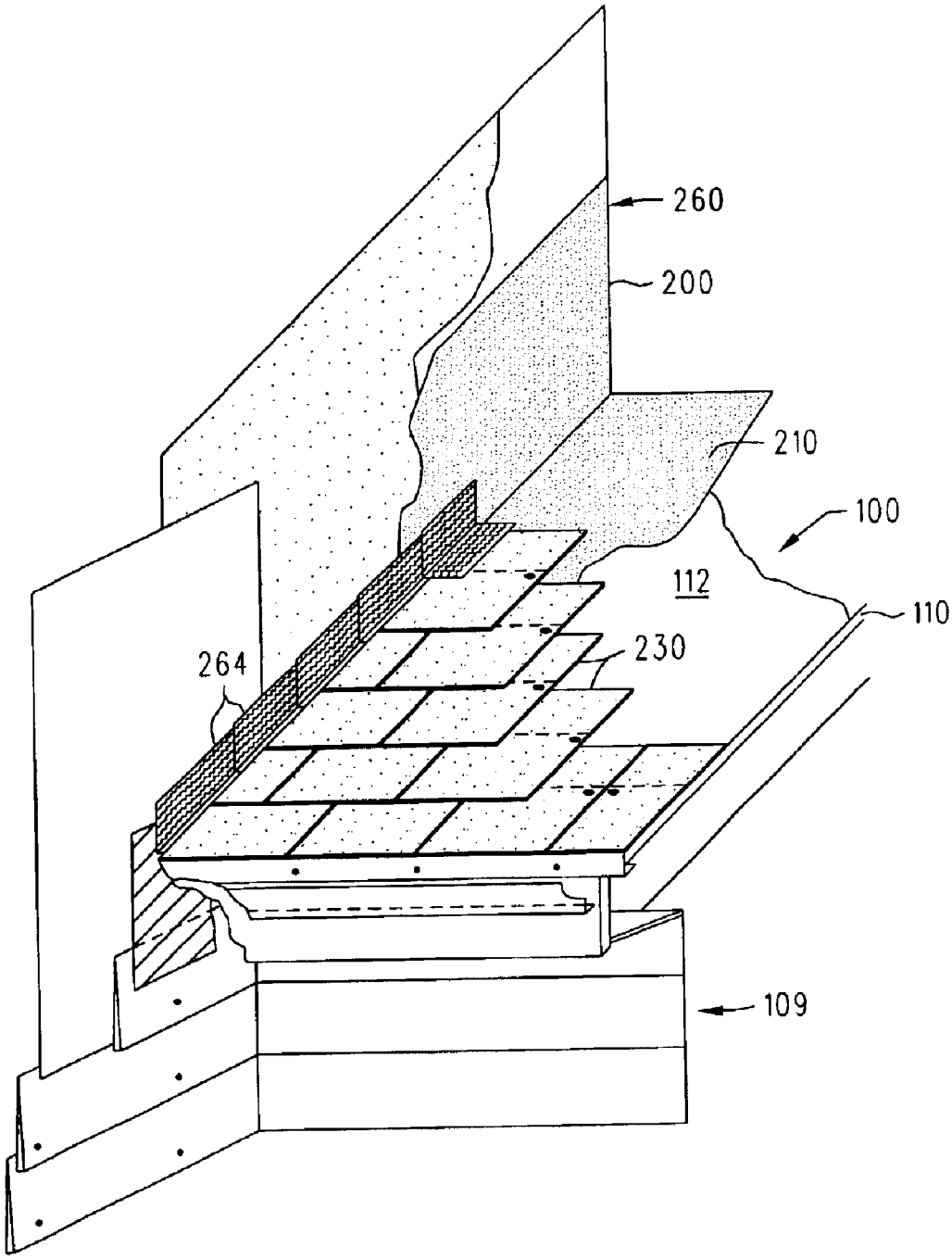
FIG. 6 is a top perspective view of a roof of the type shown in FIG. 1 intersected by a vertical wall.

Referring to FIG. 6, many roofs are intersected by vertical walls and other structures, such as pipes and chimneys. The following description describes sealing these structures with reference to sealing a vertical wall 260 that abuts the sealed roof 100. The vertical wall 260 described herein is a portion of the structure 109 that extends beyond the sealed roof 100. For example, the vertical wall 260 may be an exterior wall of a second level of the structure 109 and the sealed roof 100 may cover a first level of the structure 109.

Sealing the vertical wall 260 may, in summary, comprise affixing the membrane 200 to the vertical wall 260 and extending it up the vertical wall 260. More specifically, siding or other exterior finishes, not shown, may be removed from the vertical wall 260, thus, exposing an underlying substrate, not shown. The membrane 200 may then be applied to the underlying substrate of the vertical wall 260. For example, the membrane 200 be extended from the sealed roof 100 and may be adhered to the vertical wall 260 as described with reference to the shingles 112 shown in FIG. 2. Thus, a continuous waterproof membrane extends from the sealed roof 100 up the vertical wall 260. The membrane 200 may extend to various heights depending on the susceptibility of the vertical wall 260 to water leakage. For example, the membrane 200 may extend up the vertical wall 260 approximately 18 inches from the sealed roof 100. Alternatively, the membrane 200 may fully cover the vertical wall 260. Conventional step flashing 264 may then be placed on the membrane 200 so as to be located beneath the second layer of shingles 230 in a conventional manner. The step flashing 264 further ensures that water does not seep into the vertical wall 260. In addition, the step flashing 264 assures that water will between the vertical wall 260 and the sealed roof 100.

Siding or other conventional finishing materials may be placed over the membrane 200 and secured to the vertical wall 260 in a conventional manner. Fasteners, not shown, may pass through the siding and the membrane 200 to attach the siding to the vertical wall 260. As was described above with reference to the fasteners 240 illustrated in FIG. 1, the membrane 200 seals the fasteners that may be used to secure the siding to the vertical wall 260. Accordingly, the vertical wall 260 and the junction of the sealed roof 100 and the vertical wall 260 are sealed and prevent water from entering the structure 109.

The above-described method of sealing the vertical wall 260 may be applicable to sealing other structures that abut the sealed roof 100. For example, the method may be applied to sealing the junctions between the sealed roof 100 and skylights, chimneys, and ventilation ducts.

Figure 7:
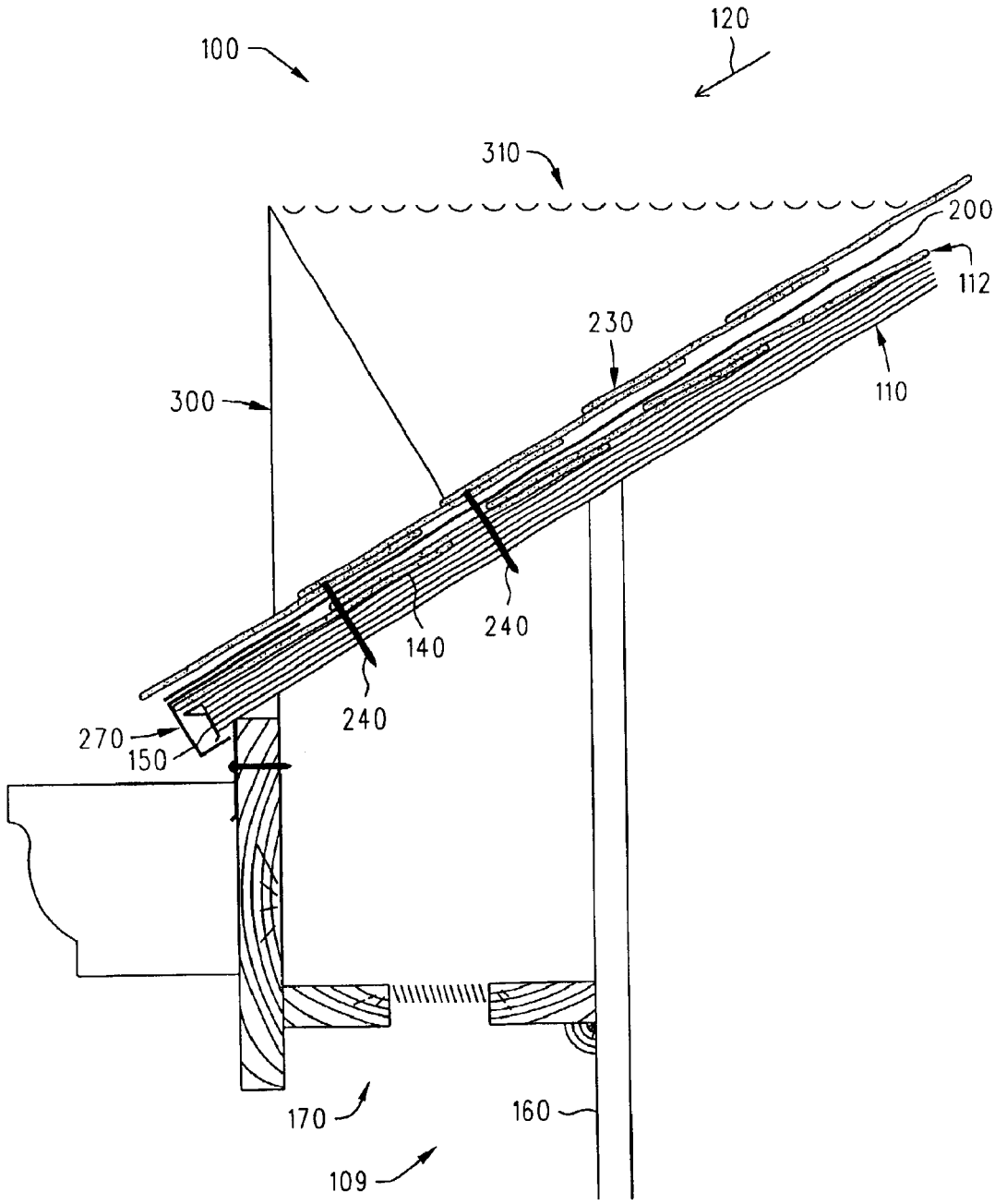
FIG. 7 is a side, cut away schematic illustration of the sealed roof of FIG. 1 with an ice dam located thereon.

Having described the sealed roof 100, FIG. 1, and a method of sealing a conventional roof 108, the sealed roof 100 will now be described repelling water from entering the structure 109. Referring to FIG. 7, which is a side, cut away schematic illustration of the sealed roof 100 of FIG. 1, an ice dam 300 may form above the eave 170 of sealed roof 100. The formation of the ice dam 300 causes water 310 to pool on the sealed roof 100. The water 310 may seep under the second layer of shingles 230 and may contact the membrane 200. The membrane 200 is waterproof and, thus, prevents the water 310 from contacting the substrate 110. Additionally, the membrane 200 seals around the fasteners 240, thus, assuring that the water 310 will not seep around the fasteners 240 to penetrate the substrate 110. Accordingly, the structure 109 is shielded from the water 310.

As outlined above, the ice dam 300 can build up over the eave 170, which will cause water to back up onto the roof. In the situation where vertical structures abut the sealed roof 100, the water 310 will likely contact these structures. For example, referring to FIG. 6, the vertical wall 260 abuts the sealed roof 100. The vertical wall 260, however, has the membrane extending a distance up the vertical wall 260 and, thus, prevents water from entering the structure 109 via the vertical wall 260.

Referring again to FIG. 4, the membrane 200 has been described as either having an adhesive bottom side 212 or having an adhesive applied to the bottom side 212. It should be noted that the top side 210 of the membrane 200 may likewise be adhesive or have an adhesive applied thereto. This permits the second layer of shingles 230, FIG. 1 to be adhered to the membrane 200.

Referring again to FIG. 2, the method of sealing a roof described herein alleviates the need to remove the shingles 112 prior to sealing the roof. This is due to the fact that conventional sealing methods require a membrane to be placed directly to the substrate 110, which requires removal of the shingles 112 in order to access the substrate 110. The shingles 112 are then discarded and a new layer of shingles is attached to the membrane. Removal of the shingles 112, however, tends to be costly. For example costs are associated with the labor to remove the shingles and the costs of disposing the shingles. In addition, the process of removing the shingles 112 may damage the substrate 110. Repairing the substrate 110 further increases the costs of sealing the conventional roof 108. The method disclosed herein overcomes these problems by placing the membrane 200, FIG. 4, onto the shingles 112, thus, not requiring the removal of the shingles 112. Accordingly, the disposal costs and substrate repair costs are eliminated until such a time as the second layer of shingles 230, FIG. 1, is required to be replaced, which is generally 20 to 30 years from the time of installation.

Method for Applying the Roof to a Structure

Application of the above-described roof and method may be performed using several different parties. In one non-limiting embodiment, a first party may serve to promote and control the above-described roof and method. The first party is sometimes referred to as the coordinator. It should be noted that in one embodiment, the coordinator may be a manufacturer of roofing products or the like. As described in greater detail below, the coordinator may hire or contract with other parties for engineering, inspection, and installation of the roof. The coordinator may also license other parties to install and/or use the above-described roof.

A third party, sometimes referred to as the engineer, may serve to evaluate the structure prior to installation of the roof and may inspect the roof during the installation process. The engineer may also develop technical specifications for installation of the above-described roof that are dependent on the specific roof design to which the above-described roof is applied. The technical specification may include replacing portions of the roof, such as flashing, and adhering the above-described membrane a minimal distance from the edge of the roof and at vertical inclines.

As described in greater detail below, the engineer may also certify the roof for various warranties. The engineer is selected by the coordinator based on various criteria and is sometimes referred to as a certified or approved engineer. The criteria may include experience with and knowledge of the above-described roof, experience and knowledge of roofing and home construction, and insurance and other professional requirements.

A second party, sometimes referred to as the installer, may install the roof as described above. The installer may be preselected by the coordinator and may be one of a plurality of installers preselected by the coordinator. As with the engineer, the coordinator may select the installers based on various criteria. These criteria may include the experience and knowledge of the above-described roof, knowledge and experience with roofing and construction, and insurance and bonding requirements. Other criteria may include whether the installer has been found liable for defective workmanship or the like, the amount of business the installer has completed in the past, local licensing requirements, and compliance with other laws.

Installation of the above-described roof may commence with an entity who owns or otherwise has control over the roof contacting the coordinator. This entity is sometimes referred to as the owner. This entity may also be a management company or the like. The owner pays the coordinator or installer a fee for installing the roof. This fee may be paid at any time during the installation of the roof.

The coordinator then instructs one of the preselected engineers to evaluate the roof. The engineer certifies the roof for a warranty that may be granted by the coordinator. More specifically, the engineer evaluates the existing roof in order to determine whether the above-described roof will be able to be installed and be granted an extended warranty. This evaluation may include several aspects, including the condition of the substrate, the condition of the existing roofing shingles, and the pitch of the roof.

The coordinator or engineer may then discuss the roof evaluation with the owner. A price and conditions for a warranty may be established by the coordinator. If terms for the installation of the roof are agreed to, the coordinator or owner may contact an installer to install the above-described roof. A licence to install and use the roof is granted to the installer and the owner. During installation of the roof, the engineer may inspect the installation to be sure that the above-described technical specification is adhered to.

The installer installs the roof per the above-described method and the technical specification set forth by the engineer. The materials used for the roof may be provided by the coordinator or by way of the coordinator. For example, the coordinator may arrange for a supplier or manufacturer of roofing products to supply products to the installer. These products are approved for use by the coordinator and/or the engineer and may bear trademarks owned by the coordinator. The use of products not approved by the coordinator and/or engineer or not installed per the technical specification may void the above-described warranties.

During the installation procedure, the engineer may inspect the installation in order to assure that the installer is properly installing the roof. If the engineer determines that the roof was properly installed, the engineer may certify these findings to the owner and/or the coordinator.

If the materials used in the roof have been approved by the coordinator, the coordinator may warranty the materials used in the roof for a first duration. As an example, the first duration may be twenty years. A condition for this warranty may also be the certification of the engineer regarding the substrate.

The coordinator may also provide a warranty on the roof for a second duration. In order to assure that funds are available for this warranty, the coordinator may place a portion of the fee received from the owner into a trust account. In another embodiment, the installer places a portion of the fee received into the trust account. For example, the coordinator or installer may place eight percent of the fee into a trust account. Placement of the funds into the trust account may be a condition for the above-described warranty. This account may be accessible by the owner in the event warranty work is required.

The above-described method enables the owner to choose between different roofing methods in the event of leakage due to an ice dam. The owner has the option of applying the above-described roof and obtaining a warranty or stripping the existing roof and applying a new layer of shingles in a conventional manner. In addition, engineers have the option of offering owners different roofing methods to solve leakage due to ice dams.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A method for sealing a roof wherein said roof is of the type comprising an inclined substrate and a first layer of shingles, wherein said first layer of shingles has a first side and a second side, and wherein said first layer of shingles first side is attached to said substrate, said method comprising:

a first party selecting a second party to seal said roof;

said first party providing a waterproof membrane having a first side and a second side to said second party;

said second party positioning said membrane first side adjacent at least a portion of said first layer of shingles second side;

said second party attaching a second layer of shingles to said substrate, wherein said second layer of shingles is adjacent said membrane second side.

2. The method of claim 1, wherein said first party provides a warranty on the sealed roof, said warranty having a first duration.

3. The method of claim 2, wherein said first duration is approximately twenty years.

4. The method of claim 1, wherein said first party provides a warranty on the sealed roof, said warranty having a second duration upon payment of a preselected monetary amount from said second party to said first party.

5. The method of claim 4, wherein said second party receives compensation for sealing said roof, and wherein said preselected amount is a portion of said compensation.

6. The method of claim 5, wherein said portion is a preselected percentage of said compensation.

7. The method of claim 4, wherein said second duration is approximately thirty years.

8. The method of claim 4, wherein a portion of said preselected monetary amount is saved in a trust account, the money is said trust account being available for said warranty.

9. The method of claim 1 and further comprising evaluating said roof prior to sealing, said evaluating being done by a third party.

10. The method of claim 9, wherein said third party generates a specification for installing said roof.

11. The method of claim 10, wherein said second party installs said roof per said specification.

12. A method for sealing a roof wherein said roof is of the type comprising an inclined substrate and a first layer of shingles, wherein said first layer of shingles has a first side and a second side, and wherein said first layer of shingles first side is attached to said substrate, said method comprising:

providing a waterproof membrane approved by a first party, said waterproof membrane having a first side and a second side;

a second party positioning said membrane first side adjacent at least a portion of said first layer of shingles second side;

said second party attaching a second layer of shingles to said substrate, wherein said second layer of shingles is adjacent said membrane second side.

13. The method of claim 12, wherein said first party provides a warranty on the sealed roof, said warranty having a first duration.

14. The method of claim 13, wherein said first duration is approximately twenty years.

15. The method of claim 12, wherein said first party provides a warranty on the sealed roof, said warranty having a second duration upon payment of a preselected monetary amount from said second party to said first party.

16. The method of claim 15, wherein said second party receives compensation for sealing said roof, and wherein said preselected amount is a portion of said compensation.

17. The method of claim 16, wherein said portion is a preselected percentage of said compensation.

18. The method of claim 15, wherein said second duration is approximately thirty years.

19. The method of claim 15, wherein a portion of said preselected monetary amount is saved in a trust account, the money is said trust account being available for said warranty.

20. The method of claim 12 and further comprising evaluating said roof prior to sealing, said evaluating being done by a third party.

21. The method of claim 12, wherein said third party generates a specification for installing said roof.

22. The method of claim 21, wherein said second party installs said roof per said specification.

* * * * *